US012297607B2

(12) United States Patent
Kappel et al.

(10) Patent No.: US 12,297,607 B2
(45) Date of Patent: May 13, 2025

(54) PAVER HAVING A HOPPER

(71) Applicants: VOLVO CONSTRUCTION EQUIPMENT AB, Eskilstuna (SE); Marc Kappel, Eskilstuna (SE); Dennis Gässler, Eskilstuna (SE); Julian Freigang, Eskilstuna (SE); Guido Hanel, Eskilstuna (SE)

(72) Inventors: Marc Kappel, Eskilstuna (SE); Dennis Gässler, Eskilstuna (SE); Julian Freigang, Eskilstuna (SE); Guido Hanel, Eskilstuna (SE)

(73) Assignee: AMMANN SCHWEIZ AG, Langenthal (CH)

( * ) Notice: Subject to any disclaimer, the term of this patent is extended or adjusted under 35 U.S.C. 154(b) by 717 days.

(21) Appl. No.: 17/596,971

(22) PCT Filed: Jun. 25, 2019

(86) PCT No.: PCT/EP2019/066901

§ 371 (c)(1),
(2) Date: Dec. 22, 2021

(87) PCT Pub. No.: WO2020/259812

PCT Pub. Date: Dec. 30, 2020

(65) Prior Publication Data

US 2022/0307206 A1 Sep. 29, 2022

(51) Int. Cl.
*E01C 19/48* (2006.01)

(52) U.S. Cl.
CPC ..... *E01C 19/48* (2013.01)

(58) Field of Classification Search
CPC ..... E01C 19/48
(Continued)

(56) References Cited

U.S. PATENT DOCUMENTS 9,151,004 B2 * 10/2015 Anderson ..... E01C 19/48
9,242,803 B2 * 1/2016 Murphy ..... B65G 21/2081
(Continued)

FOREIGN PATENT DOCUMENTS

CN 202705858 U 1/2013
CN 203593932 U 5/2014
(Continued)

OTHER PUBLICATIONS

International Search Report and Written Opinion dated Feb. 7, 2020 in corresponding International PCT Application No. PCT/EP2019/066901, 9 pages.

(Continued)

*Primary Examiner* — Gary S Hartmann
(74) *Attorney, Agent, or Firm* — Venable LLP; Jeffri A. Kaminski

(57) ABSTRACT

A paver has a conveyor unit having a first edge, a hopper unit having a front end and a rear end with respect to the paving direction and an inward paving material storage. The hopper unit is movable between a lowered position and a raised position for directing paving material towards the conveyor unit. The hopper unit includes a first hopper with a first base portion and a first wall. The first in hopper has a first hopper pivot axis adjacent to the first edge of the conveyor unit. The first base portion is pivotally arranged in respect to the first hopper pivot axis. A front part is arranged inwardly adjacent to the first hopper between the front end and the conveyor unit.

19 Claims, 7 Drawing Sheets

(58) Field of Classification Search
USPC ..... 404/110
See application file for complete search history.

(56) References Cited

U.S. PATENT DOCUMENTS

| | | | | |
|---|---|---|---|---|
| 9,481,966 | B2 * | 11/2016 | Frelich | E01C 19/48 |
| 9,580,875 | B1 * | 2/2017 | D'Ascanio | E01C 19/48 |
| 10,053,824 | B2 * | 8/2018 | Jacob | E01C 19/48 |
| 10,407,843 | B2 * | 9/2019 | Anheier | E01C 19/488 |
| 2016/0060823 | A1 * | 3/2016 | Erdtmann | E01C 19/48<br>404/110 |

FOREIGN PATENT DOCUMENTS

| | | | |
|---|---|---|---|
| CN | 104053839 | U | 9/2014 |
| CN | 206219955 | U | 6/2017 |
| DE | 202011108347 | U1 | 1/2012 |
| DE | 102016006530 | A1 | 11/2017 |
| JP | S58165007 | U | 11/1983 |
| JP | S59167807 | U | 11/1984 |

OTHER PUBLICATIONS

Chinese Office Action dated Sep. 2, 2022 in corresponding Chinese Patent Application No. 201980097877.8, 8 pages.

* cited by examiner

PAVER HAVING A HOPPER

CROSS-REFERENCE TO RELATED APPLICATIONS

This application is a U.S. National Stage application of PCT/EP2019/066901, filed Jun. 25, 2019, and published on Dec. 30, 2020, as WO 2020/259812 A1, all of which is hereby incorporated by reference in its entirety.

TECHNICAL FIELD

The invention relates to a paver comprising a conveyor unit having a first edge and preferably a second edge, and a hopper unit having a front end and a rear end with respect to the paving direction and an inward paving material storage, the hopper unit being movable between a lowered position and a raised position for directing paving material towards the conveyor unit.

Generally, a paver is to be understood as a road working machine. The invention is applicable on working machines within the field of industrial construction machines or construction equipment, in particular, pavers. Although, the invention will be described with respect to a paver, the invention is not restricted to this particular machine, but may also be used in other working machines having a hopper unit being movable between a lowered position and a raised position with a front part.

BACKGROUND

Pavers are industrial construction machines that are used to lay a road surface, usually made from asphalt or concrete. Therefore, a paver is to be understood as a piece of construction equipment used to lay asphalt or concrete on roads, bridges, parking lots, airports and other such places. It lays the asphalt or concrete flat and provides compaction before it is finally compacted by a roller.

Paving machines or pavers generally include a front mounted hopper unit for receiving paving material and a rear mounted screed which floats on the material to be paved. The screed is articulated on the chassis of the paver via tension arms. Paving material is deposited into the hopper unit by a separate loading vehicle and is conveyed from the hopper unit by means of a longitudinal conveyor unit to a distributor auger located in front of the screed. The paving material is distributed over the paving width by the distributor auger and is paved or levelled by means of the screed.

The loading vehicle is placed in front of the paver and is pushed by the paver until all the material to be paved has been emptied into the hopper. The loading vehicle is then exchanged with another loading vehicle having a full load of paving material.

Generally, hopper units in such machines are assembled as a twin hopper unit, with a first hopper and a second hopper. The first hopper and the second hopper facing each other and being positioned symmetrically on either side or edge of the conveyor unit. The first hopper and the second hopper form a paving material storage. The twin hopper set is configured to switch between a lowered position and a raised position. Generally, the twin hopper unit receives the paving material in the lowered position of the hopper unit, while in the raised position the twin hopper unit set facilitate transfer of the paving material to the conveyor unit by gravity feed. Thereafter, the conveyor unit transfers the paving material to the auger of the paver, in turn delivering the paving material to the work site.

At a front end of the hopper unit, the hopper unit optionally comprises a front part. The front part is located between the first hopper and the second hopper and between the front end and the conveyor unit. Material, which is located in the first hopper or in the second hopper is moved to the conveyor unit by the movement from the lowered position to the raised position.

Generally, the movements of the first hopper and the second hopper do interact hydraulically with the front part and not mechanically. Therefore, the front part is interconnected with movement means, in particular, hydraulic cylinders, in order to move the front part from a lowered position to a raised position. The front part is arranged at the hopper unit so that the movement means moves the front part in a way that an upper surface of the front part is rotated inwardly in the direction of the paving material storage of the hopper unit. Consequently, material located at the front part is being moved to the conveyor by gravity feed. Moreover, the hopper unit may comprise first and second aprons which act as walls at the front end of the hopper unit. The aprons can be pivotally arranged at the front edge of the first hopper and the second hopper. The aprons are usually arranged without a power unit. The aprons are usually in form-fit connection with the front part so that aprons are moved by a movement of the front part.

Such a movable front part between a lowered position and a raised position is expensive. Moreover, such a movable front part is maintenance-intensive and the probability of a default can be high. In order to reduce the costs of a paver, there are paver embodiments, which have a fixed front part, which is substantially not movable. In such pavers, the material on the front part is removed manually by an operator, for example with a scoop. This manual removal of the material being on the front part, is labor-extensive, expensive and, moreover, reduces the occupational safety.

SUMMARY

An object of the invention is to provide a paver with a hopper unit including a front part, wherein a paving material removal from the front part is executed automatically at low cost and at a high occupational safety level.

The object is achieved by a paver according to claim 1. The paver comprises a conveyor unit having a first edge and preferably a second edge. The conveyor unit preferably has a conveying direction. The conveying direction can be reverse and parallel to a paving direction and/or a direction the paver is moving during paving. Preferably, the conveyor unit conveys paving material in the direction directed from the front end to the rear end.

Next to or around the conveyor unit, a hopper unit is arranged. The hopper unit extends from the front end to the rear direction with respect to the paving direction. Furthermore, the hopper unit has an inward paving material storage. The paving material storage is formed by the first hopper and preferably by a second hopper, each having base portions and walls.

The hopper unit is movable between a lowered position and a raised position for directing paving material towards the conveyor unit by gravity feed. The hopper unit is designed and arranged in a way that, when moving the hopper unit from the lowered position to the raised position, the material in the material storage is tipped over onto the conveyor unit. For this reason, the first hopper has a first base portion and a first wall. The first base portion is substantially horizontal, in case that the hopper unit is in the lowered position. In the raised position, the base portion is inclined so that paving material drops by gravity. Moreover, the first hopper includes a first wall, which is preferably arranged at an edge of the first hopper, wherein this edge is opposite to the edge of the first hopper being located at the first edge of the conveyor unit.

The first hopper has a first hopper pivot axis being adjacent to the first edge of the conveyor unit. The first hopper is rotatable arranged around the first hopper pivot axis. In particular, the first base portion is pivotally arranged in respect to the first hopper pivot axis, so that the first hopper can be moved between the lowered position and the raised position.

The hopper unit includes a front part. The front part is arranged inwardly adjacent to the first hopper between the front end and the conveyor unit. In particular, inwardly means that the front part is part of or adjacent to the paving material storage. Preferably, the front part has an upper surface, wherein preferably the upper surface of the front part is substantially at the same horizontal level as the first base portion of the first hopper. Generally, the front part is not moved, when the hopper unit is moved from the lowered position to the raised position. Consequently, paving material located at the front part is not moved onto the conveyor unit by gravity feed.

In order to remove the paving material from the front part, the first side wing is arranged to sweep paving material from the front part onto the conveyor. The first side wing is in connection with the first base portion and configured so that, when the hopper unit is being moved in the raised position, the first side wing is being rotated inwardly and a sweep edge of the first side wing is being moved in contact with the front part.

The sweep edge of the first side wing is facing the front part. The sweep edge can be a continuous flange of the first side wing. Alternatively, the sweep edge may be designed discontinuous. A discontinuous sweep edge may have perforations or the like. For example, the sweep edge can be designed comb-shaped. In particular, being moved in contact with the front part means that paving material located on the front part can be swept by the sweep edge.

In particular, rotating inwardly means that the upper surface of the first side wing is rotated in a way that this surface is facing the material storage of the hopper unit. For example, in the lowered position of the hopper unit, the surface of the first side wing may be horizontal. When the hopper unit is moved in the raised position, this surface may be inclined and face at least partially the material storage. In particular, a perpendicular line on the surface of the front part will be tipped over in the direction of the paving material storage in a way that at least a horizontal component of this line is directing into the paving material storage.

By the provision of a paver which comprises a hopper unit including a first side wing, the advantage of an automatic removal of paving material from the front part is realized. Moreover, no actuators, in particular, hydraulic cylinders are necessary in order to tip over the front part. Therefore, occupational safety is increased as no manual removal of the material is necessary. Furthermore, less labor is necessary in order to execute the paving process. Another advantage of the invention is that this simple solution is not maintenance-intensive and can be realized with less costs.

According to one embodiment, the first side wing is pivotally attached to the first base portion, the first base portion having a first side wing pivot axis, and the first side wing pivot axis being angled to the first hopper pivot axis. An advantage of this embodiment is that the first side wing can swing around the first side wing pivot axis in respect to the first base portion. Consequently, the first side wing is advantageously rotated inwardly and the sweep edge of the first side wing is being moved in contact with the front part.

Moreover, it is preferred that the first side-wing is drive-less. In particular, a drive-less first side wing means, that the first side wing does not comprise a drive for executing the inward rotation. The rotation of the first side wing is provoked by the geometry of the first side wing and the movement of the first hopper.

According to a further embodiment, the first side wing pivot axis and the first hopper pivot axis are intersecting apart from the front end. By using an appropriate geometry of the first side wing, this embodiment advantageously supports the rotation of the first side wing.

According to a further embodiment, the first side wing pivot axis and the first hopper pivot axis include a pivot axis angle, the pivot axis angle being less than 90 degrees, wherein preferably the first side wing pivot axis extends from the first hopper pivot axis in the direction of the front edge of the hopper unit. The front edge of the hopper unit is preferably located at the front end. Hereby, an improvement is that the first side wing rotates inwardly in a harmonized way with the first hopper, in particular, with the first base portion of the first hopper.

According to a further embodiment, the first side wing comprises a sweep section which extends inwardly onto and/or beneath the front part of the hopper. Preferably, the sweep section protrudes from the remaining first side wing. It is preferred that the sweep section has a triangular geometry. Hereby an improvement is that the sweep section extending inwardly onto the front part of the hopper, so that the sweep section is at least partially responsible for a forced inward rotation of the first side wing. In the case that the sweep section extends inwardly beneath the front part, it is preferred that the front part can be moved from a lowered position to a raised position, and that the front part is pivotally arranged in a way that the first side wing is raising the front part. For example, the front part may have a front part pivot axis. The front part pivot axis can be perpendicular to the paving direction and/or to the first edge of the conveyor unit. It is preferred that the front part pivot axis is located inwardly from the front part, which means that the front part pivot axis is located at an edge of the front part which is averted to the front end of the hopper unit.

According to a further embodiment, the sweep section comprises the sweep edge. It is further preferred that a sweep element is arranged at the first side wing. The sweep element can be designed to form the sweep section The sweep element can be a bended portion of the first side wing and/or it can be a separate element which is attached to first side wing.

According to a further embodiment, the first side wing pivot axis extends from a first pivot axis end to a second pivot axis end, the first pivot axis end being located at the front edge of the base portion and/or of the hopper unit and being spaced apart from the hopper pivot axis, and the second pivot axis end being located at the hopper pivot axis and being spaced apart from the front edge of the base portion. This embodiment realizes an angle less than 90° between the first hopper pivot axis and the first side wing pivot axis. Consequently, an improved drive-less inward rotation of the first side wing is possible.

According to a further embodiment, the front edge of the first side wing and the front edge of the base portion being flushed. The front edges preferably face the front end of the hopper unit.

According to a further embodiment, the paver is characterized by a return member, which is in connection with the first side wing and adapted to return the first side wing from the inwardly rotated position when the hopper is being moved in the lowered position. Generally, the first side wing is moved back to its initial position by gravity. The return member can support this movement, in order to improve operation. In particular, this embodiment reduces the risk that the first side wing halts in its inward rotated position when the first hopper unit is moved back to the lowered position. In particular, the return member renders manual intervention unnecessary.

According to a further embodiment, the first side wing has a triangular geometry. In this embodiment the first side wing comprises three wing edges. A first wing edge is said sweep edge facing the front part. A second wing edge is facing the front end of the hopper unit. The second wing edge is substantially parallel to a front edge of the hopper unit and substantially perpendicular to the first edge of the conveyor. A third wing edge is parallel to the first side wing pivot axis. Preferably, the first side wing pivot axis is arranged at or next to the third wing edge. In particular, the triangular geometry has angles differing from 90°.

The point of intersection of the sweep edge and the second wing edge is preferably vertically above the front part. Consequently, the second wing edge and the sweep edge overhang onto the front part. Therefore, the part overhanging onto the front part formed by the second wing edge and the sweep edge is preferably the sweep section.

According to a further embodiment, the conveyor unit has a second edge being arranged opposite to the first edge, the hopper unit further includes a second hopper with a second base portion and a second wall, the second hopper having a second hopper pivot axis being adjacent to the second edge of the conveyor unit and the second base portion being pivotally arranged in respect to the second hopper pivot axis, and a second side wing, being in connection with the second base portion and configured so that, when the hopper unit is being moved in the raised position, the second side wing is being rotated inwardly and a sweep edge of the second side wing is being moved inwardly in contact with the front part.

Preferably, the second hopper is laterally reversed to the first hopper. A laterally reversed axis would be aligned parallel to the first and second edge of the conveyor being in the middle between the first edge and the second edge of the conveyor. An advantage of the second hopper in connection with the first hopper is the design of a centrally closed paving material storage. It can be preferred that the first hopper rotates clockwise around the first hopper pivot axis and the second hopper rotates counterclockwise around the second hopper pivot axis. Consequently, material stored in the first hopper and the second hopper is tipped over onto the conveyor unit.

According to a further embodiment, the front part is arranged between the first hopper and the second hopper. Therefore, the distance between the first hopper pivot axis and second hopper pivot axis may be a little bit bigger than the extension of the front part in this direction.

According to a further embodiment, the front part preferably being a stationary part, wherein preferably the front part is configured so that when the first and second wings are rotated inwardly the front part remains stationary.

According to a further embodiment, the paver is characterized by a gap between the first side wing and the second side wing, when the first hopper and the second hopper are in the raised position. For example, the gap can be between 100 and 500 mm, in particular between 200 and 250 mm. According to a further embodiment, the gap is smaller than 500 mm, or 400 mm, or 300 mm, or 200 mm, or 100 mm. The smaller the gap, the more material is removed from the front part by the first side wing and/or the second side wing.

According to a further embodiment, the sweep edge of the first side wing has a first edge dimension and the sweep edge of the second side wing has a second edge dimension, and the front part has a front part dimension perpendicular to the first and second conveyor edges, wherein the proportion of the sum of the first edge dimension and second edge dimension to the front part dimension is being smaller than 1, in particular smaller than 0.9, preferably smaller than 0.8.

BRIEF DESCRIPTION OF THE DRAWINGS

With reference to the appended drawings, below follows a more detailed description of embodiments of the invention, cited as examples.

In the drawings.

DETAILED DESCRIPTION OF EXAMPLE EMBODIMENTS OF THE INVENTION

Figure 1:
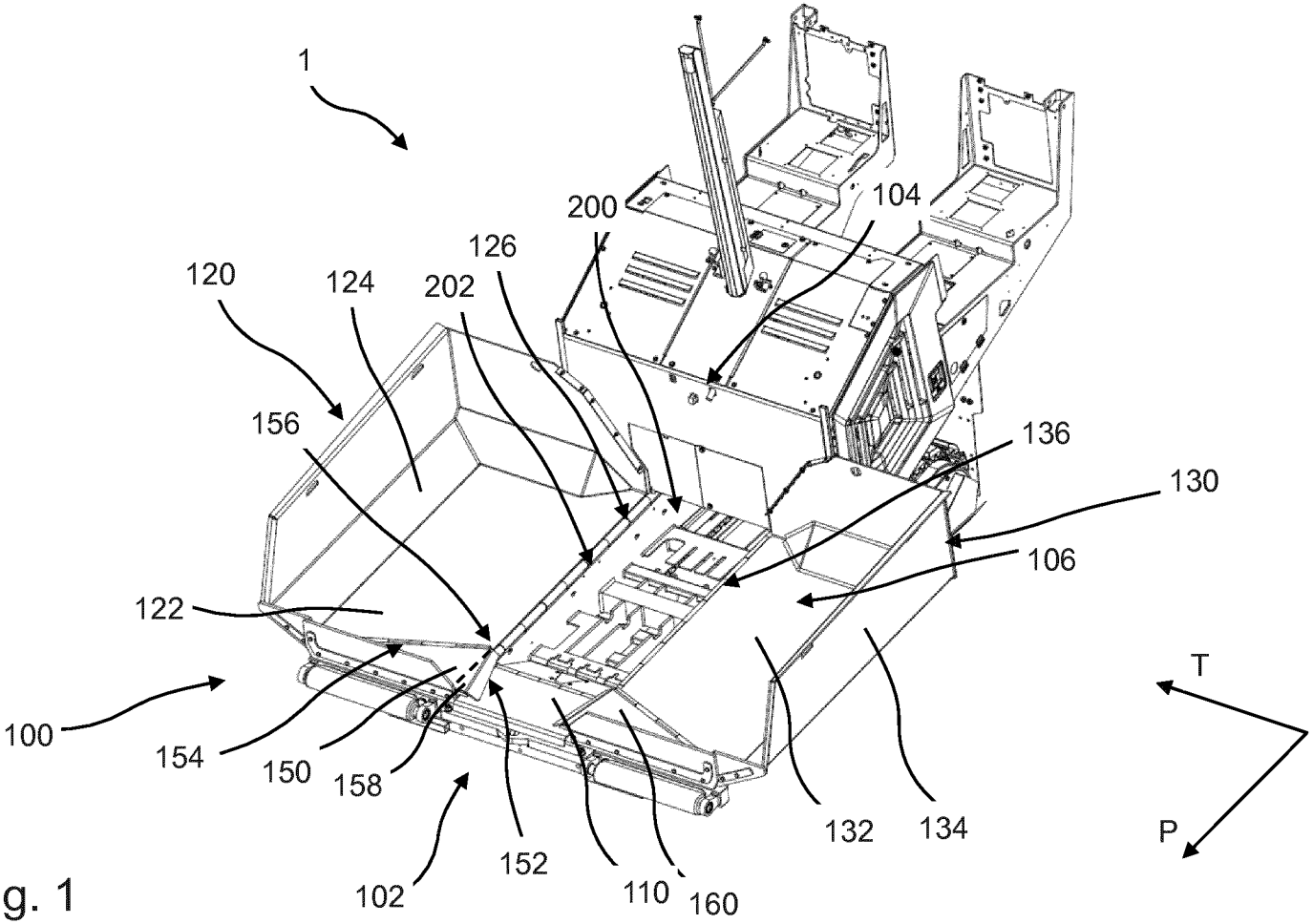
FIG. 1 is a first spatial view of a paver with an exemplary embodiment of a hopper unit in a lowered position with a side wing described herein.
Figure 2:
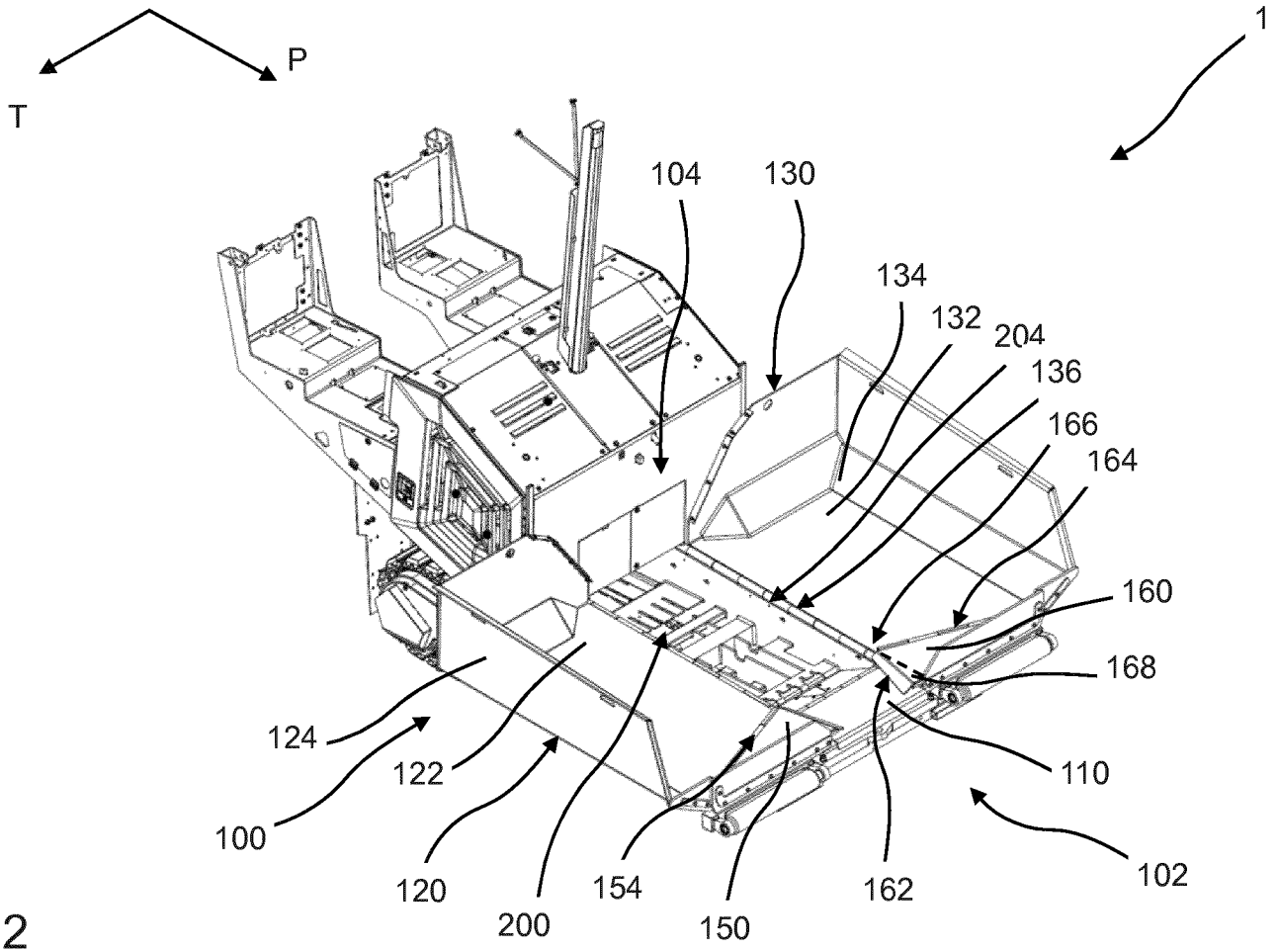
FIG. 2 is another spatial view of the paver with an exemplary embodiment of the hopper unit in a lowered position with the side wing described herein, FIG. 3*a, b* is another spatial view of the paver with an exemplary embodiment of the hopper unit in a raised position with the side wing described herein.

FIG. 1 and FIG. 2 schematically show spatial views of a paver 1 with an exemplary embodiment of a hopper unit 100 with a first side wing 150 and a second side wing 160. In paving direction P, the hopper unit extends from a rear end 104 to a front end 102. Orthogonal to this extension between the front end 102 and the rear end 104, the hopper unit 100 extends in transverse direction T. The hopper unit 100 comprises a first hopper 120 and a second hopper 130.

In transverse direction T, a conveyor unit 200 is located between the first hopper 120 and the second hopper 130. The belt of the conveyor 200 is not shown, in order to show the arrangement and the conveyor means within the conveyor unit 200. The conveyor unit 200 extends in transverse direction T between a first edge 202, which is visible in FIG. 1, and a second edge 204, which is visible in FIG. 2. The conveyor unit 200 can transfer paving material in the opposite direction to the paving direction P.

The first hopper 120 is pivotally attached at or next to the first edge 202 of the conveyor unit 200. Therefore, the first hopper 120 has a first hopper pivot axis 126. The first hopper pivot axis 126 is adjacent to the first edge 202 of the conveyor unit 200. The second hopper 130 is pivotally arranged in respect to a second hopper pivot axis 136. The second hopper pivot axis 136 is adjacent to the second edge 204 of the conveyor unit 200. The hopper pivot axes 126, 136 are substantially parallel to the first edge 202 and second edge 204 of the conveyor unit 200.

The first hopper 120 comprises a first base portion 122 and a first wall 124. The first base portion 122 is substantially horizontal when the hopper unit 100 is in the lowered position, which is shown in FIGS. 1 and 2. The first base portion 122 acts as support surface for paving material. The first wall 124 is substantially vertical and acts as lateral restriction of the paving material storage 106. The first wall 124 comprises a buckle. The second hopper 130 also includes a second base portion 132 and a second wall 134 acting as mentioned before.

The first hopper 120 and the second hopper 130 substantially form the paving material storage 106 of the hopper unit 100. In operation, a loading vehicle is located in front of the paver 1, in particular it is located at the front end 102 of the hopper unit 100. The loading vehicle can offload paving material in the hopper unit 100, so that the paving material storage 106 is loaded with the paving material.

The hopper unit 100 includes a front part 110 which is arranged inwardly adjacent to the first hopper 120 and inwardly adjacent to the second hopper 130. Therefore, the front part 110 is located between the first hopper 120 and the second hopper 130. Moreover, the front part 110 is arranged between the front end 102 and the conveyor unit 200. Preferably, the front part 110 is a stationary part, which means that the front part 110 is configured so that when the hopper unit 100 is being moved in the raised position the front part remains stationary.

The hopper unit 100 also includes a first side wing 150 being in connection with the first base portion 122. The first side wing 150 is arranged and configured so that, when the hopper unit 100 is being moved in the raised position, the first side wing 150 is being rotated inwardly and a sweep edge 152 of the first side wing 150 is being moved in contact with the front part 110. Consequently, paving material which is located on the front part 110, is removed by the first side wing 150, in particular, by the sweep edge 152.

Accordingly, the hopper unit 100 further includes a second side wing 160 being in connection with the second base portion 132 of the second hopper 130. The second side wing 160 is arranged and configured so that, when the hopper unit 100 is being moved in the raised position, the second side wing 160 is being rotated inwardly and the sweep edge 162 of the second side wing 160 is being moved inwardly in contact with the front part 110.

The first side wing 150 is pivotally attached to the first base portion 122. Moreover, the first base portion 122 has a first side wing pivot axis 154. The first side wing pivot axis 154 is angled to the first hopper pivot axis 126. These axes 126, 154 include a pivot axis angle 156, wherein the pivot axis angle is less than 90°.

When the first hopper 120 is moved in a raised position around the first hopper pivot axis 126, the first side wing 150 is forced to rotate inwardly which is caused by the geometry of the first side wing 150. In particular, this is caused by the sweep section 158 which extends over the front part 110. Because of this forced rotation of the first side wing 150, the sweep edge 152 of the first side wing 150 is being moved in contact with the front part 110. As this occurs, the front part 110 is preferably a stationary part, which means that the front part 110 is configured so that when the first side wing 150 is forced to rotate inwardly the front part 110 remains stationary.

Accordingly, and, in particular, shown in FIG. 2, the second side wing 160 also includes a sweep edge 162 and a second side wing axis 164. The second side wing axis 164 encloses a pivot axis angle 166 with the second hopper pivot axis 136. Moreover, a sweep section 168 extends over the front part 110. In a similar way to the first hopper 120 and the first side wing 150, the second side 160 wing rotates inwardly in the case that the second hopper 130 is moved in a raised position. As this occurs, the front part 110 is preferably a stationary part, which means that the front part 110 is configured so that when the second side wing 160 is forced to rotate inwardly the front part 110 remains stationary.

Figure 3A:
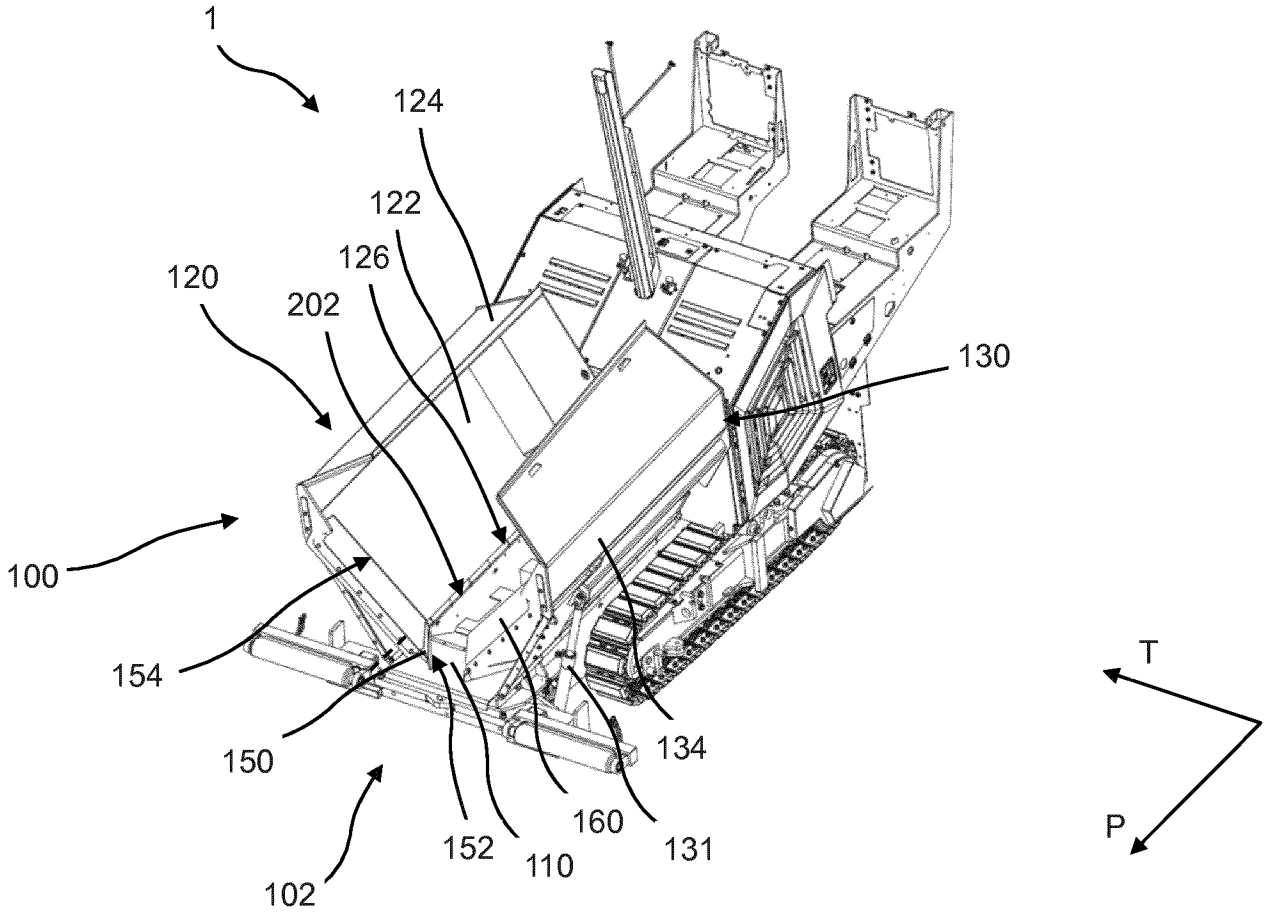
Figure 3B:
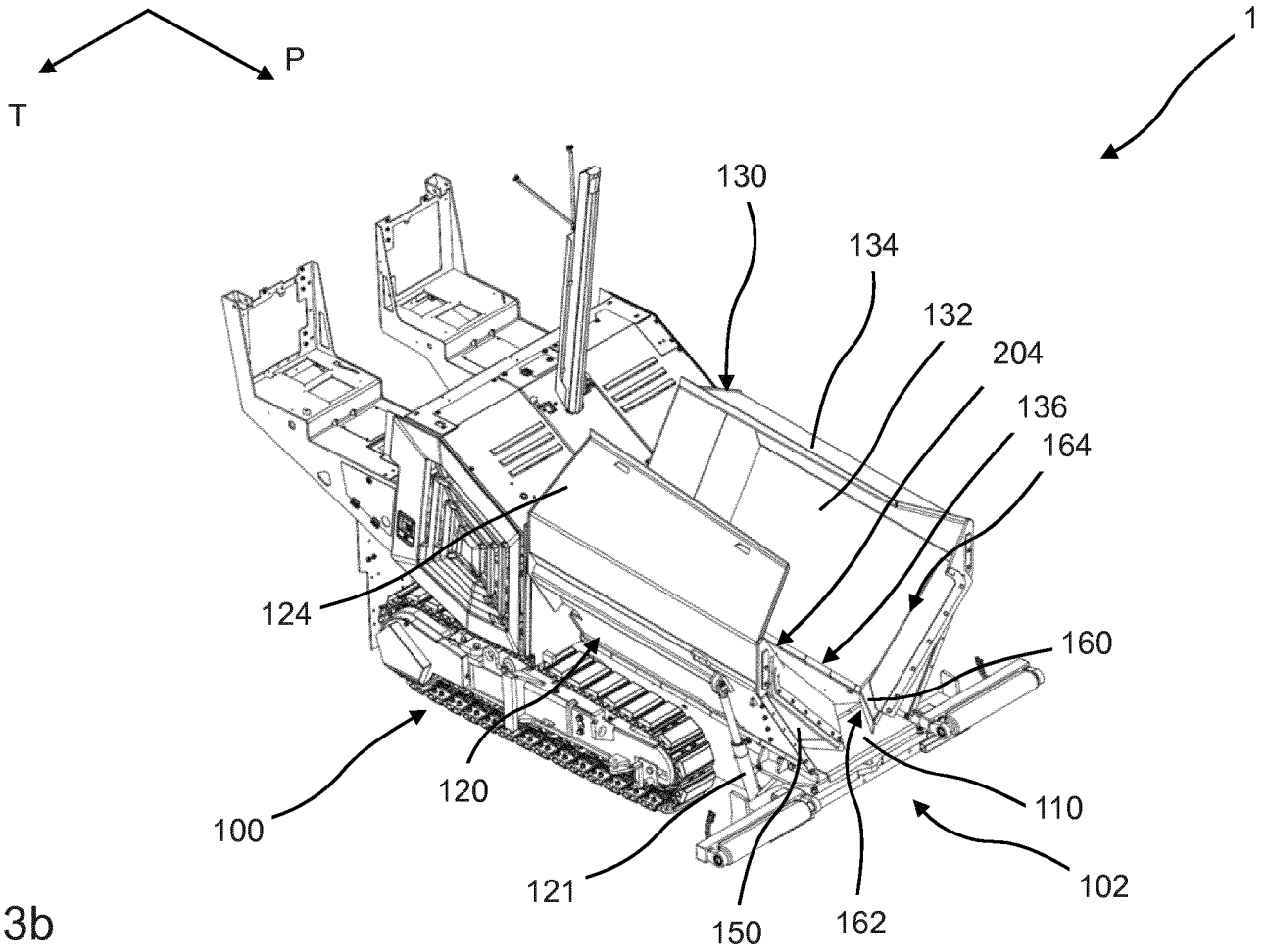

FIG. 3*a* and FIG. 3*b* show the paver described above, wherein the hopper unit 100 is being moved in a raised position. Therefore, the first hopper 120 is rotated in respect to the first hopper pivot axis 126 by a first actuator 121. The first actuator 121 is designed as a hydraulic cylinder. Alternatively, the first actuator is designed as an electric drive. In a similar way, the second hopper 130 is rotated in respect to the second hopper pivot axis 136 by a second actuator 131, which can be designed as a hydraulic cylinder and/or as an electric drive. Due to the geometry of the side wings 150, 160 and the specific rotatable attachment of the side wings 150, 160 to the base portions 122, 132 the side wings 150, 160 are rotated inwardly and the sweep edges 152, 162 are moved in contact with the front part 110. Consequently, the sweep edges 152, 162 remove paving material from the front part 110 in the direction of the conveyor unit 200. The movement of the side wings 150, 160 is performed driveless, which means that there is no need for a drive at the side wings. The movement of the hoppers 120, 130 forces the side wings 150, 160 to rotate inwardly.

Figure 4:
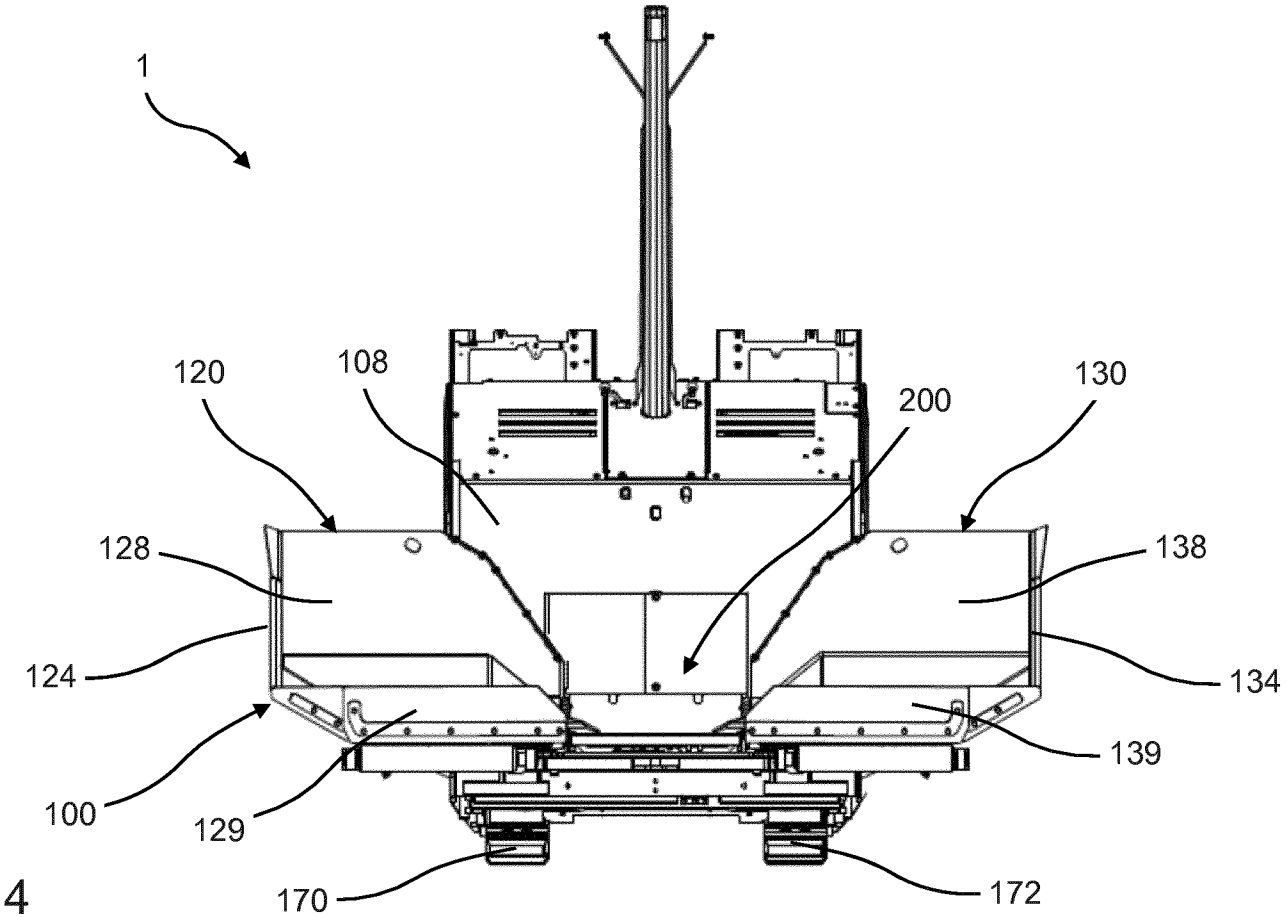
FIG. 4 is a two-dimensional front view of the paver with an exemplary embodiment of the hopper unit with the side wing described herein.

FIG. 4 shows a schematic view of the paver 1. The paver 1 includes locomotion means 170, 172. The locomotion means 170, 172 are arranged and designed so that the paver can move in paving direction by the locomotion means 170, 172.

Moreover, the first hopper 120 and the second hopper 130 each include a rear wall 128, 138. The first hopper 120 and the second hopper 130 each include a front wall 129, 139 which pretends paving material from falling out. The side wings 150, 160 are arranged inwardly in respect to the front walls 129, 139. Is preferred that the side wings 150, 160 and the front walls 129, 139 are arranged in a way, that substantially no paving material can fall between a front wall and an adjacent side wing. At the rear end 104 of the hopper unit a rear wall 108 is attached.

Figure 5:
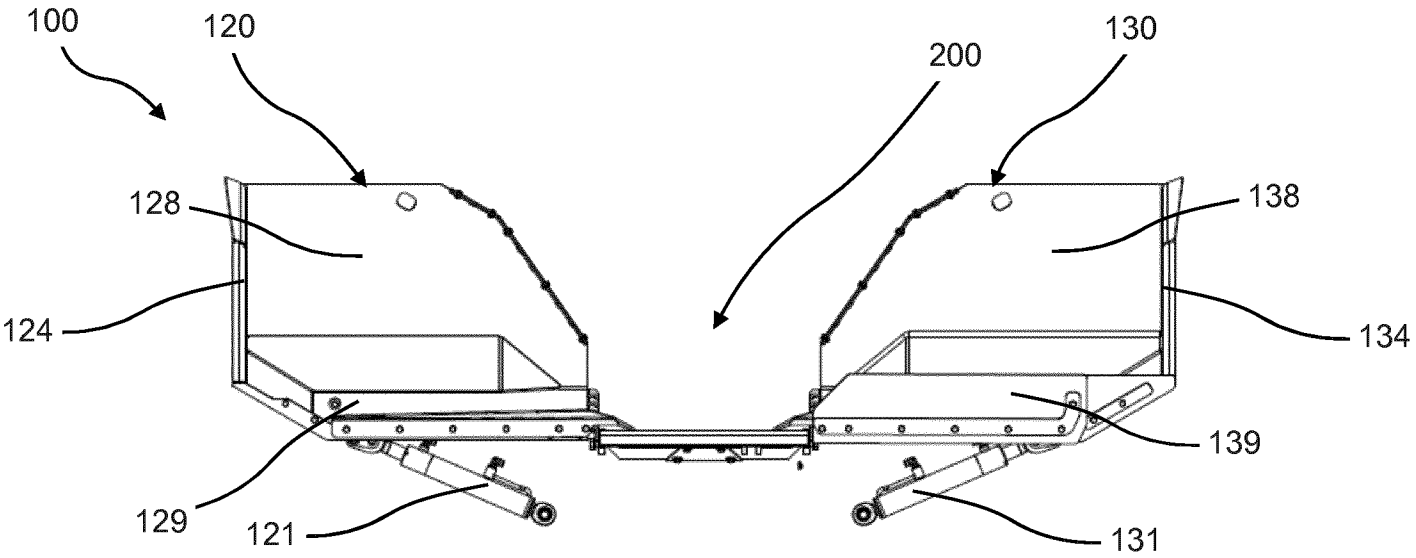
FIG. 5 is a two-dimensional front view of the hopper unit with the side wing described herein.

FIG. 5 shows a schematic view of the hopper unit 100. It is shown that the hopper unit 100 comprises a first actuator 121 and a second actuator 131. The actuators 121, 131 are hydraulic cylinders. The hydraulic cylinders 121, 131 are arranged with one end at a paver chassis. With the other end, the actuators 121, 131 are arranged at a lower portion of the hoppers 120, 130, in particular on a lower surface of the base portions 122, 132. Consequently, with the actuators 121, 131, the first hopper 120 and the second hopper 130 can be moved from a lowered position to a raised position for directing paving material towards the conveyor unit 200.

Figure 6:
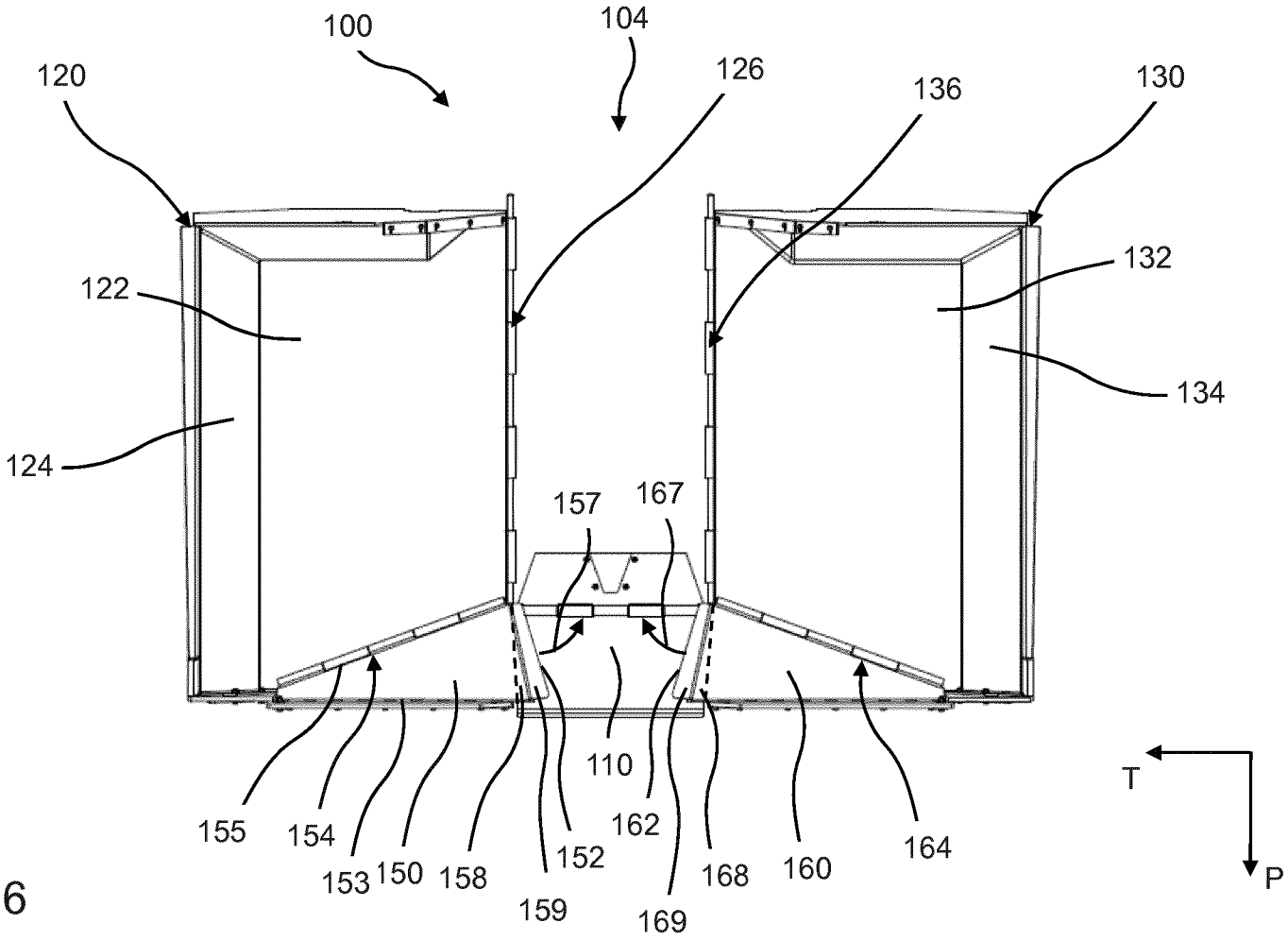
FIG. 6 is a top view of the hopper unit with the side wing described herein.

The top view of FIG. 6 schematically shows the rotating directions 157, 167 of the first side wing 150 and the second side wing 160. In particular, it is shown that, when the side wings 150, 160 rotate inwardly in the directions 157, 167, paving material located on the front part 110 is swept by the sweep edges 152, 162 in the direction of the conveyor unit 200.

The inward rotation of the side wings 150, 160 is caused by their geometries which is explained for the side wing 150 in the following. The first side wing 150 has a triangular geometry having a first wing edge 152, namely the sweep edge 152. It also has a second wing edge 153 and a third wing edge 155. The geometry of the first side wing 150 does not have a right angle. The angle included by the second wing edge 153 and the third wing edge 155 is less than 90°, in particular this angle is around 20°. The angle included by the second wing edge 153 and the sweep edge 152 is also less than 90°, in particular this angle is around 78°. The angle included by the third wing edge 155 and the sweep edge 152 is also less than 90°, in particular this angle is around 82°. As the point of intersection of the sweep edge 152 and the second wing edge 153 is vertically above the front part 110, the first side wing 150 rotates inwardly when the first hopper 120, in particular the first base portion 122 moves in the raised position.

It is to be understood that the present invention is not limited to the embodiments described above and illustrated in the drawings; rather, the skilled person will recognize that many changes and modification may be made within the scope of the appended claims.

REFERENCE NUMERALS

1 Paver
100 hopper unit
102 front end
104 rear end
106 material storage
108 rear wall
110 front part
120 first hopper
121 first actuator
122 first base portion
124 first wall
126 first hopper pivot axis
128 rear wall
129 front wall
130 second hopper
131 second actuator
132 second base portion
134 second wall
136 second hopper pivot axis
138 rear wall
139 front wall
150 first side wing
152 sweep edge
153 second edge
154 first side wing pivot axis
155 third edge
156 pivot axis angle
157 first sweep direction
158 sweep section
159 sweep element
160 second side wing
162 sweep edge
164 second side wing axis
166 pivot axis angle
167 second sweep direction
168 sweep section
169 sweep element
170 locomotion means
172 locomotion means
200 conveyor unit
202 first edge
204 second edge
P paving direction
T Transverse direction

The invention claimed is:

1. A paver, comprising a conveyor unit having a first edge, a hopper unit having a front end and a rear end with respect to the paving direction and an inward paving material storage, the hopper unit being movable between a lowered position and a raised position for directing paving material towards the conveyor unit, and wherein the hopper unit includes a first hopper with a first base portion and a first wall, the first hopper having a first hopper pivot axis being adjacent to the first edge of the conveyor unit and the first base portion being pivotally arranged in respect to the first hopper pivot axis, and a front part which is arranged inwardly adjacent to the first hopper between the front end and the conveyor unit, a first side wing, in connection with the first base portion and configured so that, when the hopper unit is moved in the raised position, the first side wing is rotated inwardly and a sweep edge of the first side wing is moved in contact with the front part, the front part being a stationary part, wherein the front part is configured so that when the first and second wings are rotated inwardly the front part remains stationary.

2. The paver according to claim 1, characterized in that the first side wing is pivotally attached to the first base portion, the first base portion having a first side wing pivot axis, and the first side wing pivot axis angled to the first hopper pivot axis.

3. The paver according to claim 2, characterized in that the first side wing pivot axis and the first hopper pivot axis intersect apart from the front end.

4. The paver according to claim 2, characterized in that the first side wing pivot axis and the first hopper pivot axis include a pivot axis angle, the pivot axis angle being less than 90 degrees.

5. The paver according to claim 1, characterized in that the first side wing comprises a sweep section extending inwardly onto and/or beneath the front part.

6. The paver according to claim 1, characterized in that the sweep section comprises the sweep edge.

7. The paver according to claim 1, characterized by a sweep element arranged at the sweep edge of the first side wing.

8. The paver according to claim 1, characterized in that the sweep element is a bended portion of the first side wing.

9. The paver according to claim 1, characterized in that the sweep element is a separated element is attached to the sweep edge.

10. The paver according to claim 1, characterized in that the first side wing pivot axis extends from a first pivot axis end to a second pivot axis end, the first pivot axis end located at a front edge of the first base portion and spaced apart from the first hopper pivot axis, and the second pivot axis end located at the first hopper pivot axis and spaced apart from the front edge of the first base portion.

11. The paver according to claim 1, characterized in that a front edge of the first side wing and the front edge of the first base portion are flush.

12. The paver according to claim 1, characterized by a return member, in connection with the first side wing and adapted to return the first side wing from the inwardly rotated position when the first hopper is moved in the lowered position.

13. The paver according to claim 1, characterized in that the first side wing has a triangular geometry.

14. The paver according to the preceding claim 1, characterized in that the triangular geometry has angles differing from 90 degrees.

15. The paver according to claim 1, characterized in that the conveyor unit having a second edge arranged opposite to the first edge, the hopper unit further includes a second hopper with a second base portion and a second wall, the second hopper having a second hopper pivot axis adjacent to the second edge of the conveyor unit and the second base portion pivotally arranged in respect to the second hopper pivot axis, and a second side wing, in connection with the second base portion and configured so that, when the hopper unit is moved in the raised position, the second side wing is rotated inwardly and a sweep edge of the second side wing is moved inwardly in contact with the front part.

16. The paver according to claim 1, characterized in that the front part is arranged between the first hopper and the second hopper.

17. The paver according to claim 1, characterized by a gap between the first side wing and the second side wing, when the first hopper and second hopper are in the raised position.

18. The paver according to the preceding claim 1, characterized in that the gap is being smaller than 500 mm.

19. The paver according to claim 1, characterized in that the sweep edge of the first side wing has a first edge dimension and the sweep edge of the second side wing has a second edge dimension, and the front part has a front part dimension orthogonal to the first and second edges of the conveyor, wherein the proportion of the sum of first edge dimension and second edge dimension to the front part dimension is being smaller 1.

* * * * *